US009789594B2

(12) United States Patent
Gutierrez

(10) Patent No.: US 9,789,594 B2
(45) Date of Patent: Oct. 17, 2017

(54) OIL FILTER WRENCH

(71) Applicant: Michael R. Gutierrez, Las Cruces, NM (US)

(72) Inventor: Michael R. Gutierrez, Las Cruces, NM (US)

( * ) Notice: Subject to any disclaimer, the term of this patent is extended or adjusted under 35 U.S.C. 154(b) by 358 days.

(21) Appl. No.: 14/547,852

(22) Filed: Nov. 19, 2014

(65) Prior Publication Data

US 2016/0136794 A1 May 19, 2016

(51) Int. Cl.
*B25B 27/00* (2006.01)

(52) U.S. Cl.
CPC ..... *B25B 27/0042* (2013.01)

(58) Field of Classification Search
CPC ..... B25B 13/52; B25B 5/147; B25B 13/481; B25B 13/463; B25B 13/505; B25B 27/0042; B25B 13/06; B25B 13/12; B25B 13/5008
See application file for complete search history.

(56) References Cited

U.S. PATENT DOCUMENTS 3,885,479 A * 5/1975 Ono ..... B25B 13/10 81/3.43
6,516,689 B1 2/2003 Bates
2004/0031358 A1* 2/2004 Badiali ..... B25B 13/467 81/57.39
2004/0118253 A1 6/2004 Trucchio
2012/0079919 A1 4/2012 Chen et al.

FOREIGN PATENT DOCUMENTS

KR 20-0153824 Y1 8/1999

OTHER PUBLICATIONS

Notification of Transmittal of the International Search Report and the Written Opinion of the International Searching Authority dated Feb. 23, 2016, in connection with corresponding International Application No. PCT/US2015/061606 (12 pgs.).

* cited by examiner

*Primary Examiner* — Robert Scruggs
(74) *Attorney, Agent, or Firm* — Maier & Maier, PLLC

(57) ABSTRACT

An oil filter wrench. The oil filter wrench includes a housing and an engagement lever. The head portion of the engagement lever has an aperture sized to receive an oil filter therethrough and may have protrusions adapted to engage the oil filter. The engagement lever is rotatable around the center of the aperture and in relation to the housing such that the handle portion of the engagement lever is movable from a first position distal to the handle of the housing to a second position proximate to the housing. The handles of the engagement lever and the housing may be gripped by one hand, allowing for ease of operation of the oil filter wrench.

17 Claims, 4 Drawing Sheets

OIL FILTER WRENCH

BACKGROUND

Spin-on type oil filters are widely used in automotive, marine, aviation, and other applications. A spin-on type filter includes both the filtering element and the housing therefor, and is typically coupled to an engine block by threads. While spin-on oil filters are simple to install, removal of the filter is frequently more difficult due to the adhesion and warping of materials after hours of engine operation. Significant torque is typically required to remove a spin-on oil filter Typical oil filter wrenches include a strap or other member to engage the oil filter housing and a handle coupled to the engagement member. A user utilizes the handle as well as the user's arm to provide the necessary torque for filter removal. This frequently requires that the user move his arm through a range of motion to impart sufficient torque to dislodge the filter.

Many engine compartments do not afford the user sufficient space for the necessary range of motion of the user's arm. In such engine compartments oil filter removal is a difficult task, and the user risks injury due to impact with surrounding engine components. A solution for oil filter removal that does not require the user to move their arm is therefore desired.

SUMMARY

According to at least one exemplary embodiment, an oil filter wrench is disclosed. The oil filter wrench can include a housing and an engagement lever. The head portion of the engagement lever can include an aperture sized to receive an oil filter therethrough and may have protrusions adapted to engage the oil filter. The engagement lever may be rotatable around the center of the aperture and in relation to the housing such that the handle portion of the engagement lever is movable from a first position distal to the handle of the housing to a second position proximate to the housing. The handles of the engagement lever and the housing may be gripped by one hand, allowing for ease of operation of the oil filter wrench.

BRIEF DESCRIPTIONS OF THE FIGURES

Figure 4A:
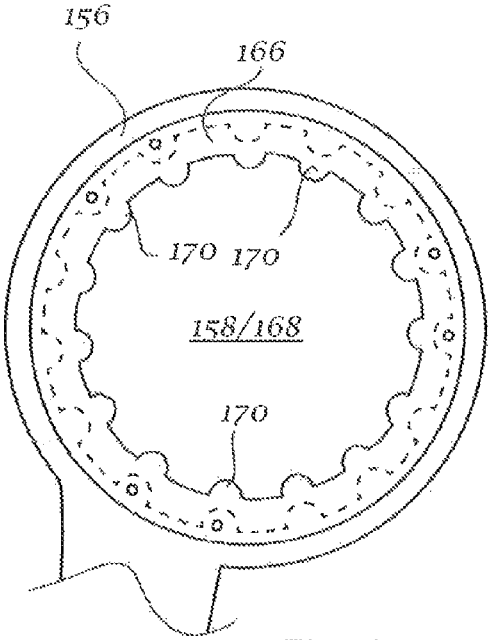

FIG. 4*a* shows an exemplary embodiment of an adapter for an oil filter wrench.

Figure 4B:
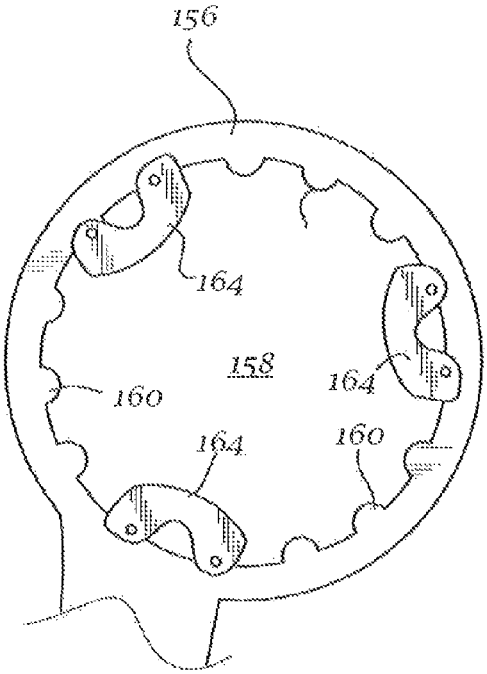

FIG. 4*b* shows another exemplary embodiment of an adapter for an oil filter wrench.

Figure 4C:
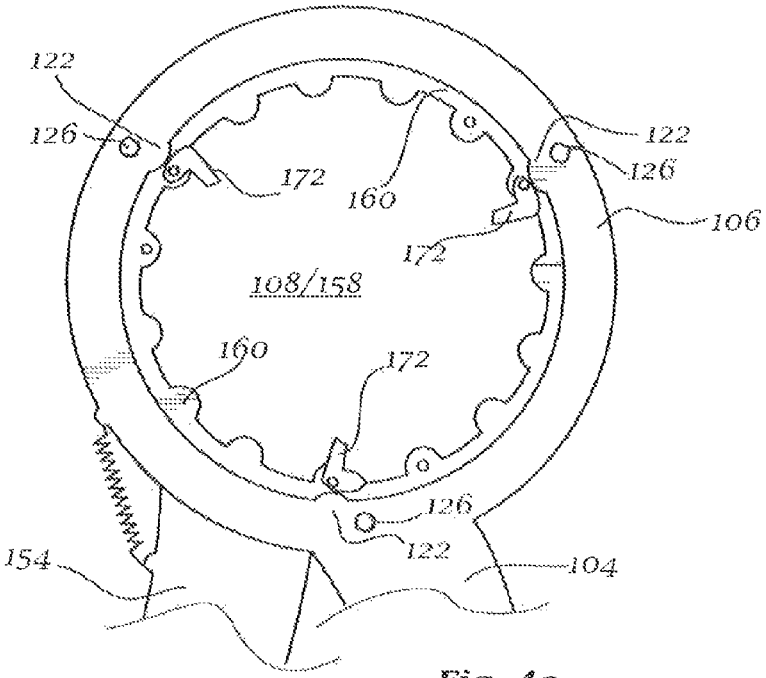

FIG. 4*c* shows another exemplary embodiment of an adapter for an oil filter wrench.

Figure 5:
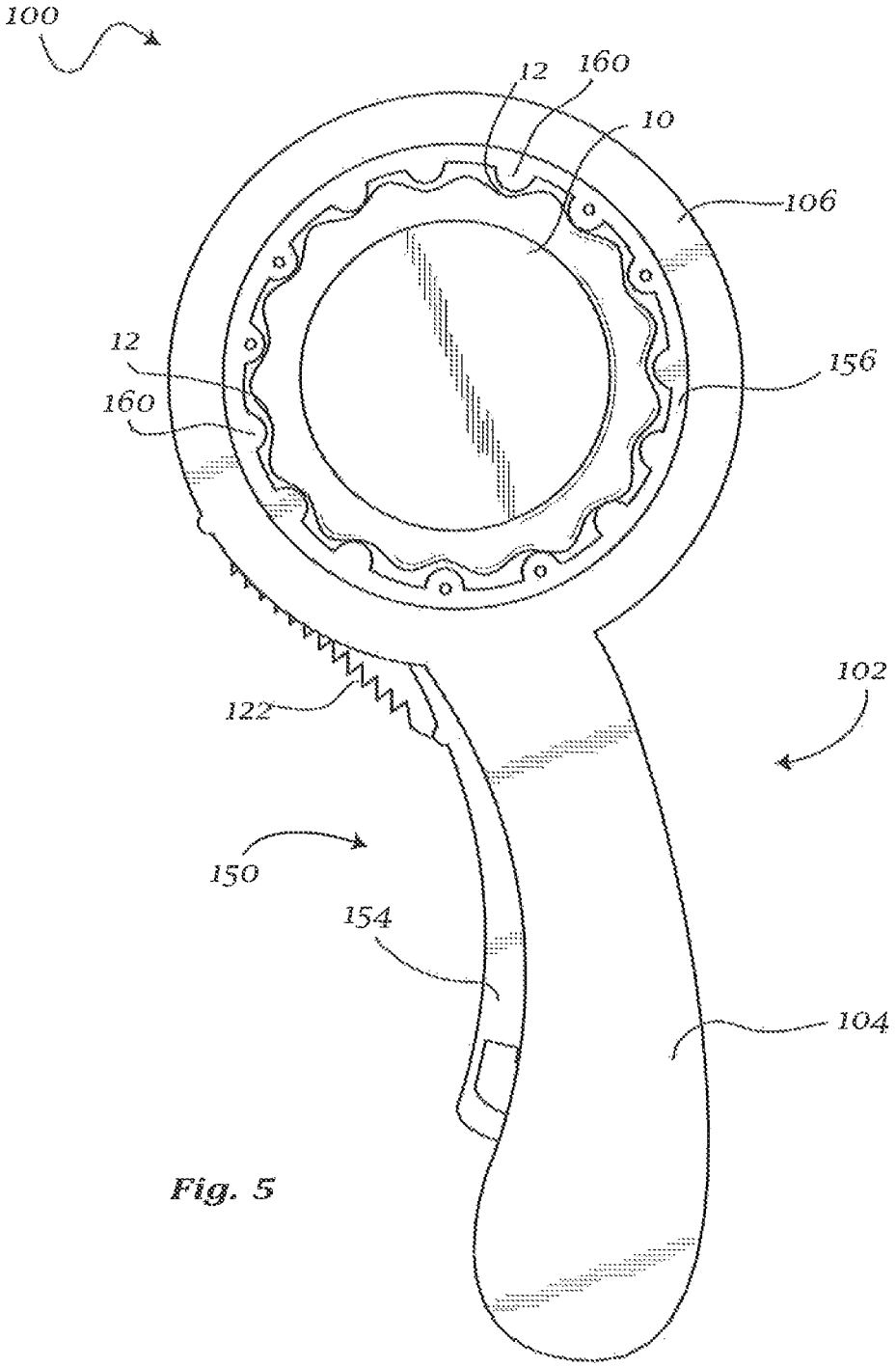

FIG. 5 shows a top view of an exemplary embodiment of an oil filter wrench in a second position.

DETAILED DESCRIPTION

Aspects of the present invention are disclosed in the following description and related figures directed to specific embodiments of the invention. Those skilled in the art will recognize that alternate embodiments may be devised without departing from the spirit or the scope of the claims.

Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage, or mode of operation.

FIGS. 1-4 show an exemplary embodiment of an oil filter wrench 100. The oil filter wrench 100 may include an outer housing 102 and an engagement lever 150 disposed within the casing. Housing 102 may be shaped to include a handle 104 and a head 106. Similarly, engagement lever 150 may include a handle 154 and a head 156. The head portion 106 of casing 102 may have an aperture 108 defined therein, and the head 156 of engagement lever 150 may have a corresponding aperture 158 defined therein. Apertures 108, 158 may be substantially concentric when wrench 100 is in an assembled state. Engagement lever 150 may be rotatably disposed within housing 102 such that lever 150 rotates about concentric point 110 of apertures 108, 158.

Housing 102 may be assembled from a first portion 112 and a second portion 114, with engagement lever 150 being disposed between first portion 112 and second portion 114. Portions 112, 114 may be made from any desired material and may be coupled by any desired means, for example adhesives, riveting or welding. Spacing between portions 112, 114 may be facilitated by head spacer 116 and handle spacer 118. Spacers 116, 118 may have a thickness greater than the thickness of engagement lever 150 so as to allow engagement lever 150 to move freely between portions 112, 114.

Figure 1:
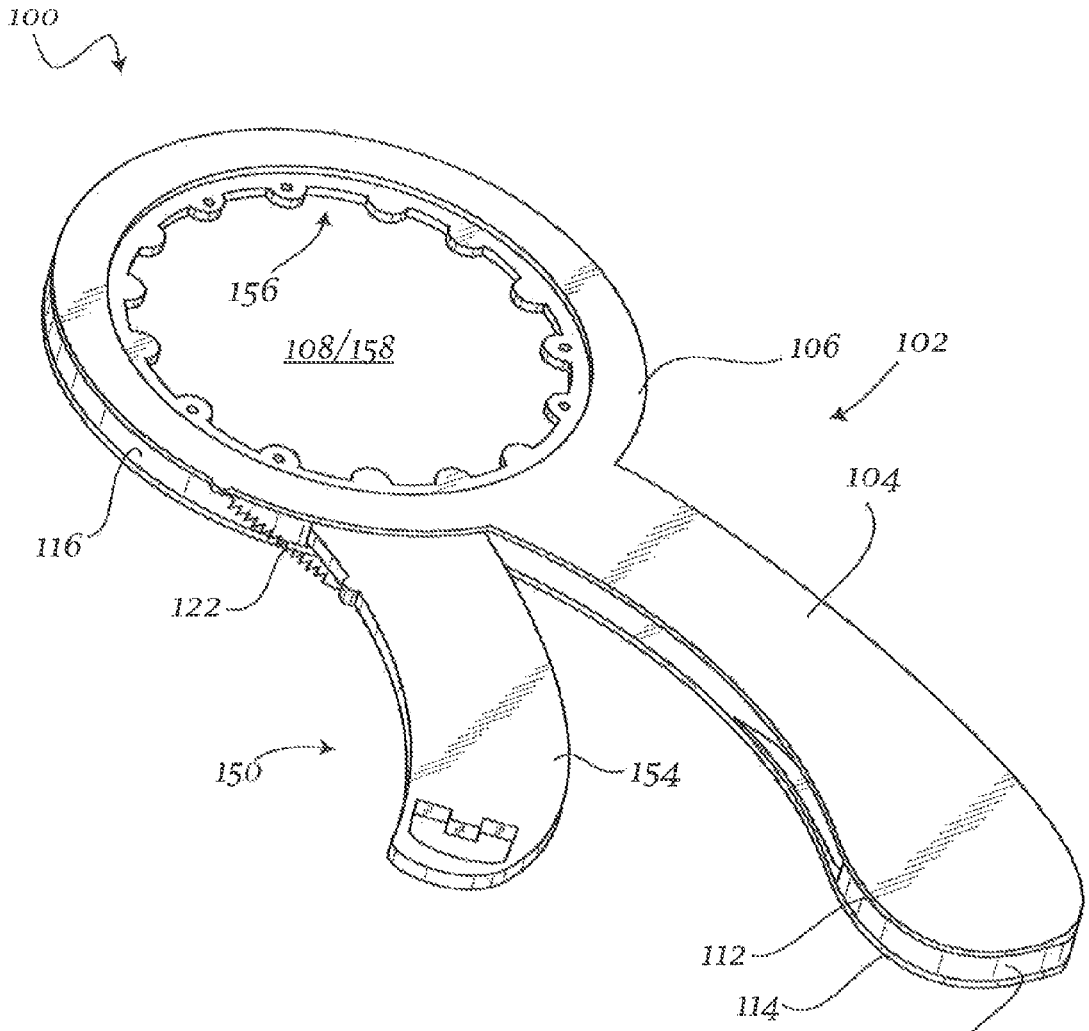
FIG. 1 shows a perspective view of an exemplary embodiment of an oil filter wrench.
Figure 2:
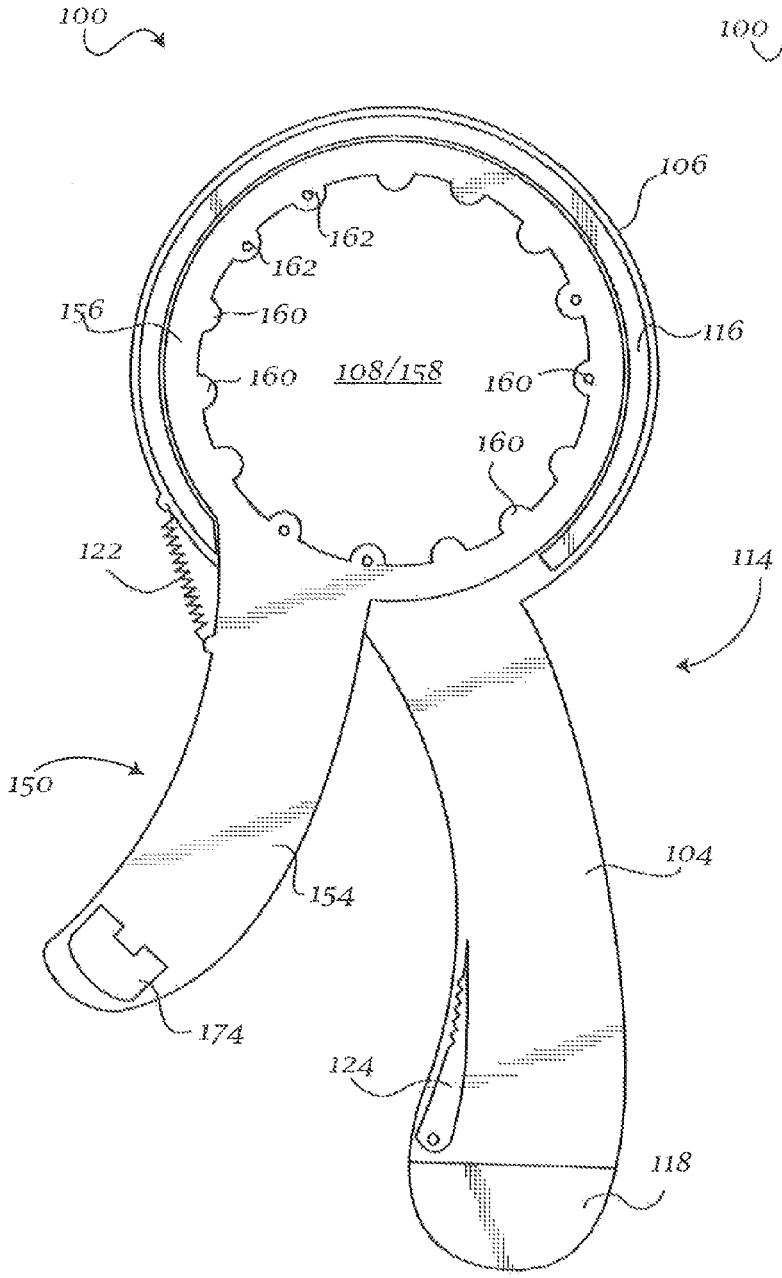
FIG. 2 is an internal top view of an exemplary embodiment of an oil filter wrench.
Figure 3:
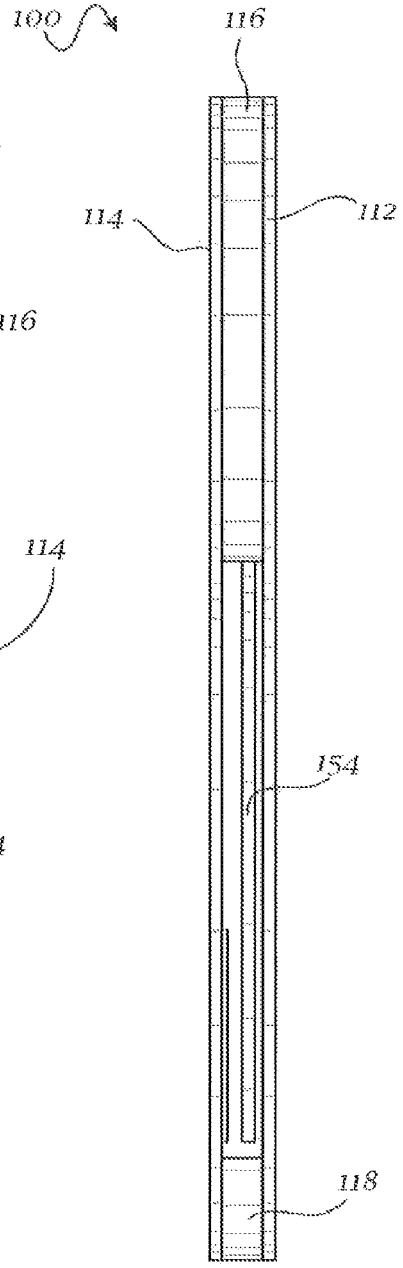
FIG. 3 is a side view of an exemplary embodiment of an oil filter wrench.

FIG. 2 shows an exemplary view of oil filter wrench 100 with first portion 112 removed so as to reveal the interior of oil filter wrench 100. Head spacer 116 may have a substantially arcuate shape and may be sized to receive a portion of the head 156 of engagement lever 150 therein. The ends 120 of head spacer 116 may engage handle 154 of engagement lever 150 so as to limit the range of rotation of engagement lever 150 with respect to casing 102. Furthermore, head spacer 116 may receive a portion of head 156 so as to retain lever 150 within housing 102. In some exemplary embodiments, low-friction elements such as coatings or bearings may be provided between head spacer 116 and head 156 so as to afford smooth and low-friction operation of wrench 100.

Head 156 may include a plurality of protrusions 160 extending into aperture 158. Protrusions 160 may be sized and shaped to be received in the grooves or facets provided on a standard spin-on oil filter. In some exemplary embodiments, head 156 may include 15 protrusions 160, so as to correspond to 15 groves defined in the surfaces of common oil filters. Attachment points 162, which may be apertures, hooks, slots or any other desired form of attachment means, may be provided on protrusions 160. Attachment points 162 may be utilized to couple one or more size adaptors thereto so as to decrease the effective radius of aperture 158 to fit a variety of oil filter sizes. Turning to FIGS. 4*a*-4*c*, the size adaptors may be shaped as arcuate lengths 164, as a ring 166 having an aperture 168 with protrusions 170 and a lesser diameter than aperture 158, or as any other desired shape that allows oil filter wrench 100 to function as described herein.

In some exemplary embodiments, claws 172 may be rotatably coupled to head 154 and extend into aperture 158. Claws 172 may be engaged by protrusions 122 defined in casing 102 as lever 150 rotates within casing 102. When claws 172 are engaged by protrusions 122, claws 172 may pivot into aperture 158 so as to engage the surface of an oil filter disposed therein, thereby providing additional gripping force, and facilitating the engagement of oil filters that have smooth surfaces without grooves or ridges.

Lever 150 may be resiliently coupled to housing 102 by a spring 122, or any other resilient member that enables wrench 100 to function as described herein. Spring 122 may retract lever 150 from a first position wherein handle 154 abuts an end 120 of head spacer 116, to a second position wherein handle 154 is disposed proximate or within handle 104.

In some exemplary embodiments, oil wrench 100 may further include a utility knife 124, for example disposed within housing 102. Oil wrench 100 may also include a toothed aperture 174, for example defined within handle 154 of lever 150. In yet other exemplary embodiments, illumination, for example LEDs 126, may be provided on the housing.

In operation, wrench 100 may be positioned such that an oil filter 10 is disposed within apertures 108, 158. Lever 150 may be positioned proximate the first position. The user may then move lever 150 towards the second position, for example by squeezing handles 104, 154 with one hand. As lever is moved towards the second position, grooves 12 of oil filter 10 may be engaged by protrusions 160 of head 156, or by adaptors 164/166, depending on the size of the oil filter 10. Alternatively, the surface of oil filter 10 may be engaged by claws 172. Consequently, oil filter 10 may be loosened by moving lever 150 from the first position to the second position. The user is therefore not required to move his arm, as the necessary torque is imparted to the oil filter by the squeezing action of moving the handle of the lever.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

The invention claimed is:

1. An oil filter wrench, comprising:

a housing; and an engagement lever in pivotal relation with the housing and having a head portion and a handle portion, the head portion having an aperture defined therein, the aperture being sized to receive a portion of an oil filter therethrough, the handle portion being selectively receivable within the housing, wherein the housing further comprises a housing head portion and a housing handle portion, the head portion having a second aperture defined therein, the second aperture being substantially concentric with the aperture of the engagement lever;

wherein the housing head portion and the head portion of the engagement lever are rotatable with respect to one another, wherein the housing head portion and the housing handle portion are fixedly coupled to one another, and wherein the handle portion of the engagement lever and the head portion of the engagement lever are fixedly coupled to one another, such that the handle portion of the engagement lever is configured to rotate about a concentric point of the aperture and the second aperture.

2. The oil filter wrench of claim 1, further comprising a plurality of protrusions extending into the aperture.

3. The oil filter wrench of claim 2, wherein the protrusions are sized and shaped to engage the surface of an oil filter.

4. The oil filter wrench of claim 2, further comprising 15 protrusions.

5. The oil filter wrench of claim 1, further comprising at least one diametric size adaptor couplable by a plurality of protrusions to the head portion of the engagement lever.

6. The oil wrench of claim 1, wherein:

the handle is movable from a first position external to the housing to a second position at least partially within the housing; and wherein movement between the first position and the second position is adapted to be accomplished utilizing one hand of a user.

7. The oil filter wrench of claim 1, further comprising a retaining member disposed within the housing head portion, the retaining member sized to rotatably maintain a part of the head portion of the engagement lever therein.

8. The oil filter wrench of claim 1, wherein the housing and the engagement lever are coupled by a resilient member, the resilient member configured to apply a restoring force to the engagement lever in the direction of a first position from a second position, the first position being a position wherein the handle portion abuts an end of a head spacer, the second position being a position wherein the handle portion is received within the housing.

9. An oil filter wrench, comprising:

a housing having a first head portion and a first handle portion, the first head portion having a first aperture defined therein; and an engagement lever in pivotal relation with the housing and having a second head portion and a second handle portion, the second head portion including a second aperture defined therein, and being rotatably disposed within the first head portion;

wherein the second aperture is sized to receive a portion of an oil filter therethrough; and wherein the first head portion and the second head portion are rotatable with respect to one another, wherein the first head portion and the first handle portion are fixedly coupled to one another, and wherein the second handle portion and the second head portion are fixedly coupled to one another, such that the second handle portion is configured to rotate about a concentric point of the aperture and the second aperture.

10. The oil filter wrench of claim 9, wherein the second handle portion is movable from a first position distal to the first handle portion to a second position proximate to the first handle portion.

11. The oil filter wrench of claim 10, wherein the second handle portion is receivable within the first handle portion.

12. The oil filter wrench of claim 10, wherein movement between the first position and the second position is adapted to be accomplished utilizing one hand of a user.

13. The oil filter wrench of claim 9, further comprising a plurality of protrusions extending into the second aperture.

14. The oil filter wrench of claim 13, wherein the protrusions are sized and shaped to engage the surface of an oil filter.

15. The oil filter wrench of claim 13, further comprising 15 protrusions.

16. The oil filter wrench of claim 9, further comprising at least one diametric size adaptor couplable by a plurality of protrusions to the second head portion.

17. The oil filter wrench of claim 9, wherein the housing and the engagement lever are coupled by a resilient member, the resilient member configured to apply a restoring force to the engagement lever in the direction of a first position from a second position, the first position being a position wherein the second handle portion abuts an end of a head spacer, the second position being a position wherein the second handle portion is received within the housing.

* * * * *